United States Patent [19]

Musgrave

[11] 4,142,313

[45] Mar. 6, 1979

[54] MAGAZINE STATUS INDICATORS

[76] Inventor: Daniel D. Musgrave, 8201 Caraway St., Cabin John, Md. 20731

[21] Appl. No.: 907,165

[22] Filed: May 18, 1978

[51] Int. Cl.[2] ..... F41C 27/14

[52] U.S. Cl. ..... 42/1 B; 42/50

[58] Field of Search ..... 42/1 B, 1 A, 50, 49, 42/7, 6

[56] References Cited

U.S. PATENT DOCUMENTS

| | | | |
|---|---|---|---|
| 1,252,094 | 1/1918 | DeLempdes | 42/1 B |
| 2,828,568 | 4/1958 | Sakewitz | 42/1 B |

*Primary Examiner*—Charles T. Jordan

[57] ABSTRACT

Indicators for cartridge magazines to inform the user if a magazine is empty; if it contains one cartridge; or if it is full. Acoustic means are disclosed by which the condition of the magazine can be determined. Also disclosed is a full-magazine indicator comprising a magazine floor which can be appreciably deformed by means within the magazine, when the magazine is full.

20 Claims, 10 Drawing Figures

MAGAZINE STATUS INDICATORS

MAGAZINE STATUS INDICATORS

Many firearms use detachable magazine which can be removed from the firearm when empty and replaced by full magazines. Some of these magazines have a large capacity so that during firing it is difficult for the user to remember how many cartridges remain in the magazine. Some firearms include devices which indicate to the user when the last shot has been expended, otherwise he might be holding an empty firearm and not be aware of the situation. Obviously, it would be an advantage if the user could be informed when he still has one shot available; thus he could exchange magazines while the firearm still has the capability to fire a shot.

Of course, it should be understood that in most firearms having magazines, when only one shot remains it is in the barrel, and the magazine is empty. But some firearms ram the cartridge from the magazine only when it is to be fired.

With either arrangement, if the user can be made aware that he has only one cartridge remaining in the firearm, he can either fire it, or retain it ready to fire while he exchanges magazines.

It might also be desirable to inform the user when any particular magazine is full.

In consideration of the aforesaid circumstances, the principal object of this invention is to provide status indicators by which the user can determine if a magazine is empty, or if it is full, or if it contains one cartridge.

Figure 1:
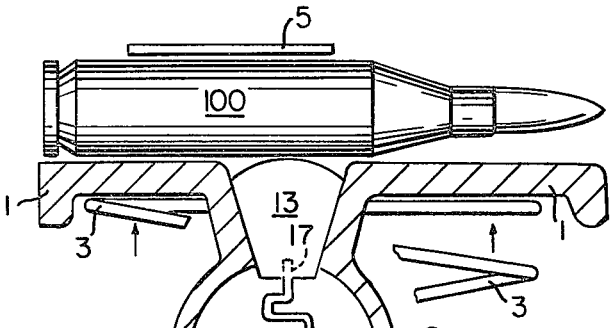
Figure 2:
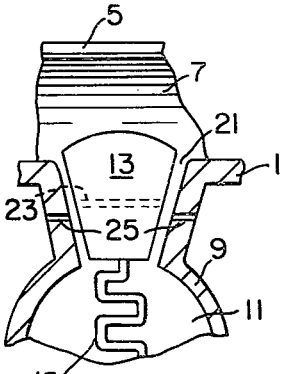
Figure 3:
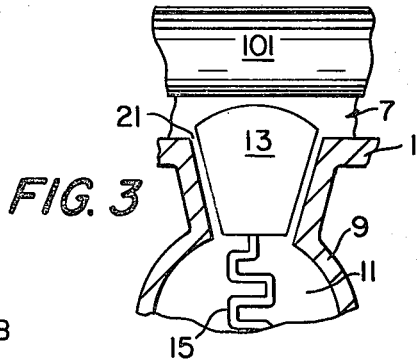
Figure 10:
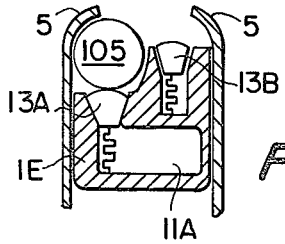
Figure 6:
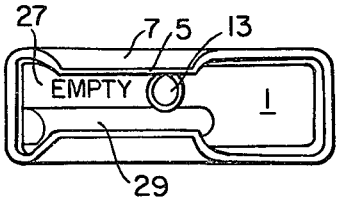
Figure 4:
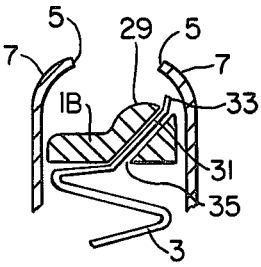
Figure 7:
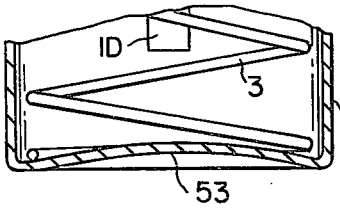
Figure 5:
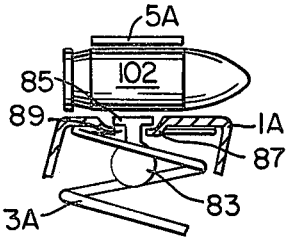
Figure 8:
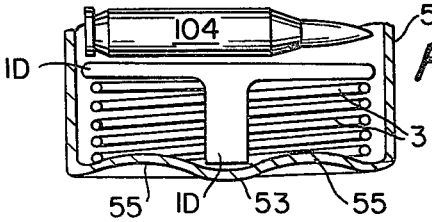
Figure 9:
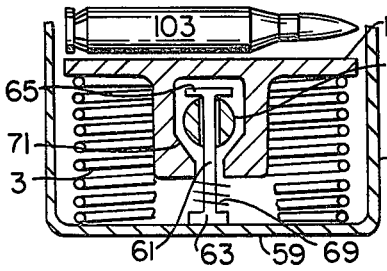

This and other objects of the present invention will be apparent upon reference to the following specification, taken in connection with the accompanying drawings, wherein:

- FIG. 1 is a sectioned view of a follower for a cartridge magazine with a sonic indicator included therein.
- FIG. 2 is a portion of the follower shown in FIG. 1 with a part in a different position.
- FIG. 3 is similar to FIG. 2, but a part of a firearm is positioned near the indicator.
- FIG. 4 is a sectioned view of a follower is a magazine and adapted to serve as an indicator.
- FIG. 5 is a view of a follower with a different arrangement of a sonic indicator.
- FIG. 6 is a top view of a magazine with a follower having both sonic and visible indicating means thereon.
- FIG. 7 is a sectioned view of a portion of a magazine having a deformable floor.
- FIG. 8 is similar to FIG. 7 and shows how the floor can be deformed.
- FIG. 9 is a sectioned view of a portion of a magazine having a follower with acoustic means thereon for indicating when said magazine is full.
- FIG. 10 is a sketch showing how two sonic indicators can be used on a magazine follower.

The drawings are not to scale and in some places the clearance between parts is exagerated for clarity. The drawings do not show any particular magazine.

Referring to the drawings in detail, FIG. 1 shows a cartridge follower 1 for use in a typical magazine. Follower 1 is urged upward by a magazine spring 3, the thrust of the spring being indicated by two arrows near the spring. The follower is pressing a cartridge 100 toward a feed lip 5 of the magazine in the usual manner.

For convenience of disclosure only one cartridge is shown in the magazine, and the only parts of the magazine visible in FIG. 1 are the spring and the feed lip.

The follower has a base 9 which is made in the form of an echo chamber 11. A recess 21 is formed in the follower and it is numbered in FIG. 2. Positioned loosely in the recess is a chapter 13, mounted on a spring 15 by any convenient means 17. Spring 15 is affixed in the echo chamber by any convenient means 19.

FIG. 2 is similar to FIG. 1 but the cartridge has been removed, and the side wall 7, of the magazine is visible. Removal of the cartridge has allowed clapper 13 to rise slightly as a result of the thrust of spring 15. As the clapper and recess 21 are both tapered, the clapper can now move within the recess to a limited extent.

Hole 23 through the clapper, and corresponding holes 25 through base 9 of the follower can be used for insertion of a pin, if it is desired to prevent movement of the clapper for any reason.

FIG. 3 is similar to FIG. 2, but a portion of the firearm, breech bolt 101, is positioned close above the clapper, which is free to vibrate against the sides of recess 21.

FIG. 4 shows an alternate arrangement. Within a magazine follower 1B is lifted by a wire coil spring 3. The upper end 31 of the spring passes through a hole 35 formed through the follower. This permits the end 33 of the spring to contact the wall 7 of the magazine near lip 5. (For clarity, the parts are shown with a gap between them).

The result of this arrangement is that while any cartridges are in the magazine, the pressure of the spring forces the follower against the cartridges and it cannot rattle. But when all cartridges have been removed, the upper surface 29 of the follower is unable to contact feed lip 5 because end 33 of the spring is protruding above 29. The follower is thus free to rattle.

It is readily apparent that if one cartridge was present on the lower (left) level of the follower, rattling could not take place.

FIG. 5 shows another arrangement. A follower 1A is being lifted by a spring 3A and is pressing a cartridge 102 against a feed lip 5A. Formed in the follower is a depression 87 having a hole 89 in the center thereof. A rattle 83 is positioned below the follower with its neck passing loosely through hole 89, and connected to a head 85 which rests in depression 87.

For purpose of clarity the drawing has a slight gap between the cartridge, and the follower with head 85 in its depression. In actual practice they will touch.

The effect of this arrangement is that so long as a cartridge is present, the cartridge presses head 85 into the depression and prevents rattling. The dimensions of the parts are so chosen that when the magazine is empty head 85 will not contact lip 5, and therefore 83 can rattle.

FIG. 6 is a view looking down into the feed mouth of a magazine having the arrangement shown in FIG. 1. Visible in follower 1 is clapper 13. The follower also has the usual ridge 29 and on its lower level, as indicated by numeral 27, is marked the word EMPTY. If a single cartridge is present, the word will be concealed. This serves as an additional method of indicating that the magazine is empty.

FIG. 7 and FIG. 8 show a different type of indicator. These views show the lower portion of a magazine casing 51 having a flexible floor 53. In FIG. 7 the floor is dished inward but other shapes could be used. Also visible in FIG. 7 is a portion of a follower 1D which is lifted by a spring 3 in the usual manner. From the position of the follower in FIG. 7 it can be assumed that the magazine is not full.

In FIG. 8 the magazine is full, cartridge 104 being the lowest in the magazine, and the follower has contacted floor 53 and distorted it so that only portions numbered 55 remain as before. The user can readily ascertain this condition by touch.

FIG. 10 shows schematically how two sonic indicators can be used on a follower 1E. Clapper 13A is positioned so as to cooperate with echo chamber 11A, while clapper 13B is simply mounted in a recess. This will produce a different sonic indication from each clapper. If desired, they could be made of different material, or with different dimensions, to accentuate the difference in sound.

In FIG. 10 only one cartridge is present in the magazine so it is positioned on the lower level of follower 1E. As no cartridge is touching clapper 13B, it can vibrate and give a sonic indication.

When cartridge 105 is removed from the magazine both clappers will be able to vibrate, but the resulting sound will differ from that made by one clapper.

FIG. 9 shows a sonic indicator adapted to inform the user when a magazine is full. Cartridge 103 is the lowest cartridge in a stack which fills the magazine. It rests on follower 1C which is compressing lifting spring 3 against floor 59 of casing 57.

Carried in the hollow base of follower 1C is a plunger 61 which is urged toward the floor of the magazine by spring 69 acting against the lower head 63 of the plunger.

The upper head 65 of the plunger is located within the hollow base of the follower, where it can contact a ring-like rattle 67 which loosely encompasses the plunger. In FIG. 9 it will be noted that rattle 67 is free to move to a limited extent.

If some cartridges are removed from the magazine, the follower will rise, permitting spring 69 to move the plunger out of the base of the follower. This will cause upper head 65 to push rattle 67 into the lower flared walls 71 of the cavity, thereby prevent it from rattling. Rattling indicates a full magazine.

In operation, a cartridge magazine having a follower such as that shown in FIG. 1 will give a sonic indication when the last cartridge is rammed out of the magazine because the clapper will be free to vibrate on spring 15. The signal would thus continue after the sound of a shot has died away.

If the firearm is one which is capable of ceasing fire with the breech bolt either open or closed, depending upon circumstances, then the sonic signal will differ according to whether or not the breech bolt is in a position to modify the effect of the echo chamber.

If the user wishes to prevent the sonic indication he can insert a pin through holes 23 and 25 as described. To insure that a clapper will not stick in its recess it can be coated with a lubricant. With the disclosed sonic indicators the status of magazines can be determined by shaking them. The acoustic means can be located on various parts of a magazine, other than the follower.

What I claim is:

1. In a cartridge magazine, acoustic means positionally adapted to be capable of providing a sonic indication concerning the state of supply of cartridges in said magazine.

2. A cartridge magazine as set forth in claim 1 wherein said means can provide said indication when said magazine is empty of cartridges.

3. A cartridge magazine as set forth in claim 1 wherein said means can provide said indication when said magazine contains only one cartridge.

4. A cartridge magazine as set forth in claim 1 wherein said means can provide said indication when said magazine is full to capacity with cartridges.

5. Acoustic means as set forth in claim 1 further provided with means to optionally prevent said sonic indication.

6. On a cartridge follower for use in a magazine acoustic means positionally adapted to be capable of providing a sonic indication concerning the state of supply of cartridges in said magazine.

7. Acoustic means as set forth in claim 6, said means being plural and each of said means being adapted to provide a different sonic indication.

8. Acoustic means as set forth in claim 6 wherein said indication can be provided when said magazine is empty of cartridges.

9. Acoustic means as set forth in claim 6 wherein said indication can be provided when said magazine contains only one cartridge.

10. Acoustic means as set forth in claim 6 wherein said indication can be provided when said magazine is full to capacity with cartridges.

11. Acoustic means as set forth in claim 6 comprising a rattle mounted on said follower and adapted for relative motion therewith.

12. Acoustic means as set forth in claim 11 wherein said rattle is so mounted that a cartridge positioned against said follower can inhibit said relative motion.

13. A combination as set forth in claim 6 wherein said follower itself is positionally adapted to rattle against a portion of said magazine when said magazine is empty of cartridges.

14. Acoustic means as set forth in claim 6 comprising a clapper resiliently mounted on said follower whereby said clapper is adapted for vibration against said follower.

15. Acoustic means as set forth in claim 14 wherein said clapper is so arranged on said follower that a cartridge positioned against said follower can inhibit said vibration.

16. Acoustic means as set forth in claim 14 wherein said clapper is coated with a substance having a low coefficient of friction.

17. Acoustic means as set forth in claim 6 wherein said follower is further provided with resonant means positionally adapted to reinforce said sonic indication.

18. Acoustic means as set forth in claim 17 wherein said resonant means includes an opening positionally adapted to cooperate with an object juxtaposed said opening whereby said sonic indication can be modified.

19. On a cartridge magazine follower, acoustic means positionally adapted to be capable of providing a sonic indication when said follower is positioned against a floor of a magazine while said follower is installed in said magazine.

20. A cartridge magazine having a flexible floor and a movable follower adapted to contact and appreciably deform said floor when said magazine is full to capacity with cartridges.

* * * * *